United States Patent [19]

Schulze et al.

[11] 4,307,840

[45] Dec. 29, 1981

[54] SPRAY NOZZLE ARRANGEMENTS FOR HIGH PRESSURE CLEANING APPARATUS

[75] Inventors: Werner Schulze, Winnenden-Höfen; Bohumir Svoboda, Winnenden; Helmut Gassert, Allmersbach, all of Fed. Rep. of Germany

[73] Assignee: Alfred Kärcher GmbH & Co., Winnenden, Fed. Rep. of Germany

[21] Appl. No.: 121,159

[22] Filed: Feb. 13, 1980

[30] Foreign Application Priority Data

Feb. 21, 1979 [DE] Fed. Rep. of Germany ..... 2906648

[51] Int. Cl.[3] ..... B05B 1/32

[52] U.S. Cl. ..... 239/451; 239/591; 239/DIG. 19

[58] Field of Search ..... 239/437, 451, 455, 504, 239/513, 590.3, 591, DIG. 19, 390

[56] References Cited

U.S. PATENT DOCUMENTS 595,014 12/1897 Doolittle ..... 239/451

2,343,958 3/1944 Crowe ..... 239/591

3,003,706 10/1961 Thorne ..... 239/513 X

FOREIGN PATENT DOCUMENTS 1695120 9/1954 Fed. Rep. of Germany .

2501948 7/1976 Fed. Rep. of Germany .

13934 of 1897 United Kingdom ..... 239/451

*Primary Examiner*—Andres Kashnikow

*Attorney, Agent, or Firm*—Laubscher, Philpitt & Laubscher

[57] ABSTRACT

A spray nozzle arrangement is provided for high pressure cleaning apparatus with an outlet nozzle of circular cross-section. A deforming member is arranged downstream of the nozzle and comprises two swing elements having substantially planar faces. The swing elements pivot about a rotary axis perpendicular to the jet. Thus, the two faces can be inclined symmetrically relative to the jet axis so that the region of the faces remote from the outlet nozzle enter the round jet, resulting in a fan-shaped jet.

16 Claims, 11 Drawing Figures

SPRAY NOZZLE ARRANGEMENTS FOR HIGH PRESSURE CLEANING APPARATUS

BACKGROUND OF THE INVENTION

The invention relates to a spray nozzle arrangement for high pressure cleaning apparatus with an outlet nozzle of circular cross-section.

In high pressure cleaning apparatuses the necessity exists regularly to produce jets of different cross-sectional shape, in order to satisfy the various demands. Thus for example, for strongly adhering contamination (cleaning chains in building machinery, removal of dung in pigsties and the like), a point jet with a high impact pressure and small area output is required. For the cleaning of sensitive surfaces (lacquered car body parts, tile-covered floors and so forth), however, a flat jet is required which, for example, has an opening angle of 60°, a low impact pressure and large area output.

For producing these different jet forms, nozzle systems have been known heretofore, wherein change-over can be effected from one nozzle to another by actuation of a slider member. The displaceable parts of such a slider member system are sealed against each other by means of O-ring seals. A disadvantage of this construction resides in that it is restricted to a low number of fixedly predetermined jet shapes, for example two or three jet shapes. A stepless control of the jet shape and thus optimum adjustment to the prevailing circumstances is impossible.

Rotary change-over nozzles are also known in which four different nozzle openings with different jet angles are accommodated in a nozzle disc and are rotated by means of a resiliently pressed seal until the desired nozzle opening is arranged over the water supply bore. In this construction, too, stepless adjustment to the cleaning tasks is impossible.

It has also been proposed to insert a knife-edge body into one side of a high pressure jet in a nozzle arrangement and to change the shape of the jet in this way (German patent application Pat. No. 27 36 314.0). However, by inserting a knife-edge into one side of a round jet, a flat jet having the desired distribution of liquid and a uniform impact pressure over the entire jet width, such as is necessary for fulfilling the cleaning tasks, cannot be produced. Moreover, a great disadvantage of the arrangement described in patent application Pat. No. 27 36 314.0 resides in the fact that, due to the immersion of the knife-edge body, the spray direction of the jet is deflected and thereby the exit angle is changed relatively to the manually guided spraying device. Thereby the torque is altered which acts upon the spraying device (in such apparatus the liquid issues at a pressure of for example 100 atmospheres).

Furthermore, the jet change necessitates a complicated adjustment of the operator to this jet angle.

The German Pat. No. 471 399 describes a compressed air thrower device, in which a jet of compressed air is formed to a broad rectangular jet shape which is variable, for the purpose of throwing or conveying mortar. In this construction, the variable opening in conjunction with the static pressure of the compressed air in front of the nozzle determines the issuing quantity of compressed air and the exit speed of the compressed air. It is impossible in this arrangement to produce a round jet and to convert the same steplessly to a flat jet, such as is necessary in high pressure cleaning apparatus.

Finally a device for changing the jet of a gardening hose is known in which a tongue is inserted into one side of the issuing water jet by means of a lever which must be actuated by hand, and thereby effects a fanformation of the jet (U.S. Pat. No. 3,003,706). With this kind of change the disadvantages of the irregular water distribution in the jet as well as the deflection of the jet from the original exit direction occur again—disadvantages which are certainly without importance for the intended purpose of use of watering the garden, but which are extremely important for the jet of a high pressure cleaning apparatus which jet issues at a high pressure. Moreover, the tongue must be continuously retained manually in the operative position by means of the lever and thereby ties down one hand. In high pressure cleaning, a hand in the vicinity of the issuing hot cleaning jet which is mixed with chemicals constitutes a risk. Moreover in high pressure cleaning, both hands are required for effecting the same, because of the loading occurring due to the high exit pressure.

SUMMARY OF THE INVENTION

According to the invention, there is provided a spray nozzle arrangement for high pressure cleaning apparatus with an outlet nozzle of circular cross-section, comprising a deforming member which is arranged downstream of the outlet nozzle and which comprises two swing elements having substantially planar faces which face the jet, the swing elements being pivotal about a rotary axis extending perpendicular to the direction of the jet so that the two faces can be inclined symmetrically relative to the jet axis, whereby the region of the faces remote from the outlet nozzle enter the round jet.

It is thus possible to provide a spray nozzle arrangement especially for high pressure cleaning apparatus in which, starting from a high pressure jet of circular cross-section, a stepless fan-formation of the jet is obtainable, wherein the distribution of liquid and energy in the entire spread-out jet is substantially uniform and wherein no one sided deflection of the jet occurs owing to the fan-formation thereof.

Thus for converting the round jet to fan-shape, substantially flat faces are rotated commonly and symmetrically in respect of the jet direction from both sides of the round jet in such a manner that their front edge dips into the jet. Depending upon the immersion depth, the jet may be spread out thereby to a more or less large angle. Surprisingly it has been found that with this procedure a distribution adjusts itself which is largely uniform in respect of spray quantity and spray energy, over the width of the fan. Because of the symmetrical immersion of the swing elements into the jet, any one sided influence on the jet is also avoided, so that no additional forces are exerted by the alteration of the jet on the manually guided spraying device.

Preferably, the swing elements are mounted in a self-jamming manner, that is to say they remain in the selected position after an intentional adjustment without rotating to a different position.

In a preferred constructional example of the invention, the swing elements are shaft pieces which are flattened on one side and which are commonly mounted in a rotatable manner in a bore which is arranged perpendicular to the direction of the jet in a casing surrounding the outlet nozzle. In the region of the rotary axis, spacer elements may be disposed between the faces and may preferably be constructed in the form of balls.

For the purpose of adjusting the faces, the shaft pieces may each comprise an extension which is arranged eccentrically in respect of the rotary axis and projects laterally beyond the bore and by means of which the shaft pieces are rotatable.

In a preferred constructional example, a guide sleeve which is rotatable about the longitudinal axis of the casing is arranged on the casing and has two symmetrically arranged obliquely extending grooves, wherein each extension protrudes into the respective grioove. When the guide sleeve is rotated about the longitudinal axis of the casing, the shaft pieces can be rotated thereby about an axis which is located perpendicular to the longitudinal axis of the casing. This mounting provides simultaneously ensurance for automatic jamming.

Preferably, the guide sleeve is constructed in two parts and is embraced by an actuator member which is non-rotatably connected to the two parts of the guide sleeve. In this case the actuator member consists preferably of a material with poor heat conductance, in order to facilitate the operating ability.

Preferably, the swing elements consist of a corrosion resistant and wear resistant material, at least in the region of the faces, preferably hardened high-grade steel, ceramic, or hard metal.

The regions of the faces which dip into the jet may be formed by inserts of a corrosion resistant and wear resistant material.

Preferably, the faces are provided with grooves which extend parallel to the direction of the jet and which extend over the entire length of the faces. These grooves serve for sucking in air and thereby for an improvement of the jet qualities. The interior of the casing may be in communication with the exterior in the region in front of the deforming member. For the better adjustment of the jet shape to the respective use, it is advantageous for the outlet nozzle to be interchangeable. The casing may be screwed upon a spray pipe and with the outlet nozzle pressed against the front end of the spray pipe by means of an abutment.

BRIEF DESCRIPTION OF THE FIGURES

The invention will be further described, by way of example, with reference to the accompanying drawings, in which.

DETAILED DESCRIPTION

Figure 1:
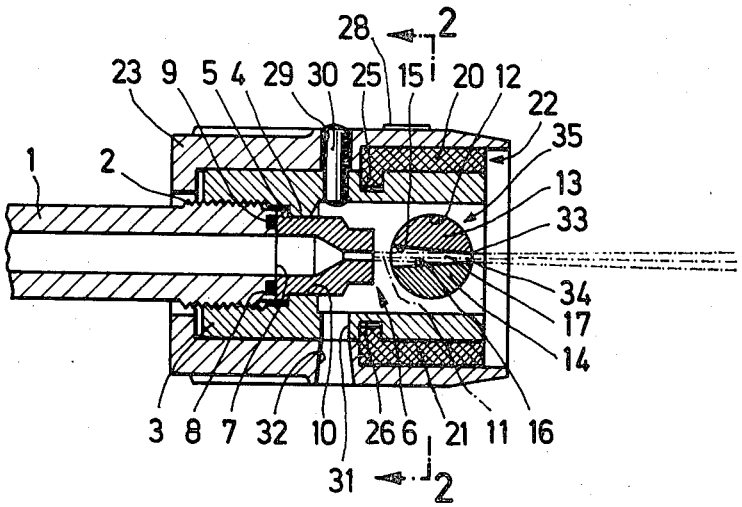
FIG. 1 is a longitudinal sectional view of a spray nozzle arrangement constituting a preferred embodiment of the invention.

A substantially cylindrical casing 3 is screwed upon the front end of a spray pipe 1 provided with an external screw thread 2. The casing 3 is in the form of a cylindrical sleeve and comprises on its inside a ring shoulder 4 which rests upon a ring flange 5 of an outlet nozzle 6 when the casing 3 is screwed upon the spray pipe 1 and thereby presses the outlet nozzle 6 against the front end 7 of the spray pipe 1. A ring seal 9 is inserted in a ring groove 8 in the front end 7 of the spray pipe 1, so that a tight connection is produced between the spray pipe and the outlet nozzle 6. The outlet nozzle 6 is symmetrically constructed in respect of its longitudinal axis and is guided by the inner face 10 of the ring shoulder 4 which rests with very little play on the outside of the outlet nozzle 6. The outlet nozzle 6 produces a round jet 11 in a manner known per se.

Figure 2:
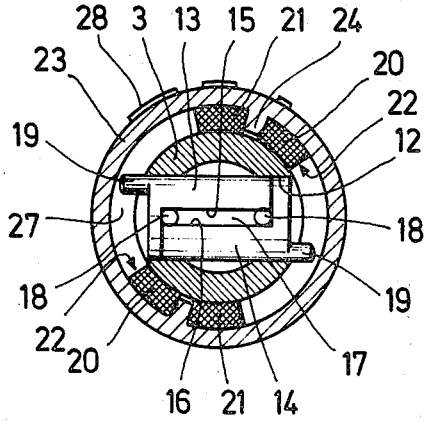
FIG. 2 is a sectional view on the line 2—2 in FIG. 1.

In the region in front of the outlet nozzle 6, the casing 3 comprises a bore 12 (FIGS. 1 and 2) which extends across the longitudinal axis of the casing and thus across the direction of the jet, and in which two shaft pieces 13, 14 are rotatably mounted which are flat on their side facing the jet 11, but which are otherwise cylindrical. As may be seen from FIG. 2, a step has been produced, always from one side, in the two similarly constructed cylindrical shaft pieces, in such a manner that, with the two shaft pieces in a parallel position, a gap 17 results between the substantially planar faces 15 and 16 if, as illustrated in FIG. 2, the two shaft pieces are pushed axially towards each other. For the purpose of fixing the spacing between the two shaft pieces, spacer elements 18 are disposed in the region of the longitudinal axis of the bore and are constructed in the form of balls in the present constructional example. The dimensions of the shaft pieces, the thickness of the casing wall, and the arrangement of the bore 12 have been selected such that both shaft pieces 13 and 14 pushed together in an axial direction lie against the internal wall of the bore in the peripheral direction in the region of the bore 12 located in the casing wall, and are guided thereby.

The longitudinal axis of the bore 12 is disposed perpendicular to the longitudinal axis of the casing 3 and extends through the center of the jet 11.

Each of the shaft pieces 13 and 14 carries an extension 19 which is arranged eccentrically with respect to the longitudinal axis of the bore 12 and which projects beyond the bore 12 and the periphery of the casing 3.

Two cylindrical guide half-shells 20 and 21 are placed around the casing 3; together they form a guide sleeve 22. They are retained in their position by an actuator sleeve 23 which surrounds them and which surrounds the casing 3 directly upstream of the outlet nozzle 6 (FIG. 1). The guide half-shells 20 and 21 and the actuator sleeve 23 are non-rotatably connected together by ledges 24 on the inside of the actuator sleeve 23 which engage between the guide half-shells 20 and 21 (FIG. 2). For axially fixing the guide half-shells 20 and 21, the latter engage by means of a flange-like rim 25 into a peripheral groove 26 in the casing 3.

Each guide half-shell 20, 21 has arranged therein an obliquely extending groove or an obliquely extending slot 27 into which engages the corresponding extension 19 of the associated shaft piece 13 or 14, respectively.

The grooves or the slots 27 are constructed so that, upon rotation of the guide sleeve 22 about the longitudinal axis of the casing, the shaft pieces are swung in opposite directions about the longitudinal axis of the bore 12. At the same time the faces 15 and 16 are always disposed symmetrically in respect of the plane formed by the longitudinal axis of the casing and the longitudinal axis of the bore.

The actuator sleeve 23 consists preferably of a material with poor heat conductance, for example a polyamide or an acetaldehyde resin. At its outer periphery, it supports a scale or symbols 28 which, in co-operation with a pin 30 fixed to the casing and extending through a slot 29 in the actuator sleeve 23, indicate the angular position of the actuator sleeve 23 and thereby the angular position of the shaft pieces 13 and 14.

The interior of the casing 3 is in communication with the exterior through an opening 31 and a following slot 32 extending in the peripheral direction in the actuator sleeve 23.

Figure 3:
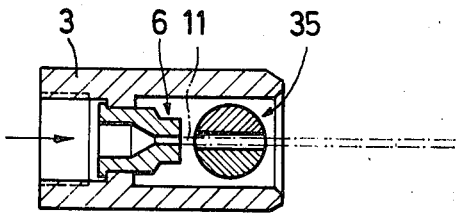
FIG. 3 is a diagrammatic longitudinal sectional view of a spray nozzle arrangement similar to the one illustrated in FIG. 1, in the production of a round jet.
Figure 4:
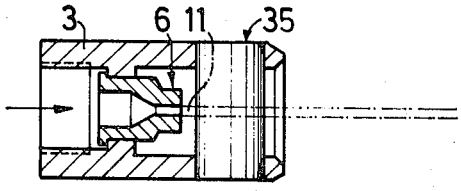
FIG. 4 is a view from above of the spray nozzle arrangement of FIG. 3.

In the operation of the apparatus, the shaft pieces 13 and 14 are first adjusted by rotation of the actuator sleeve about the longitudinal axis of the casing so that they are arranged parallel to each other in the direction of the jet; this is illustrated diagrammatically in FIG. 3. In this position, the round jet 11 formed by the outlet nozzle 6 does not touch the faces 15 and 16 and travels unimpeded through the gap 17. Thus with this position an unchanged round jet is obtained (FIGS. 3 and 4).

Figure 5:
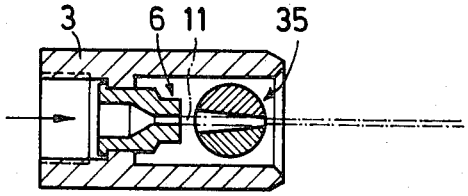
FIG. 5 is an illustration of a spray nozzle arrangement similar to FIG. 3 with a position of deflector elements for producing a jet having a fan-shape of approximately 30°.
Figure 6:
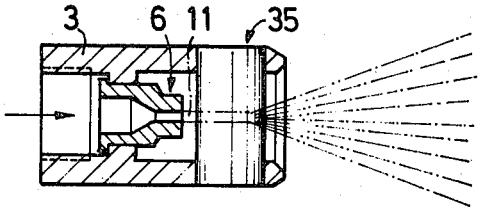
FIG. 6 is a view from above of the spray nozzle arrangement of FIG. 5.
Figure 7:
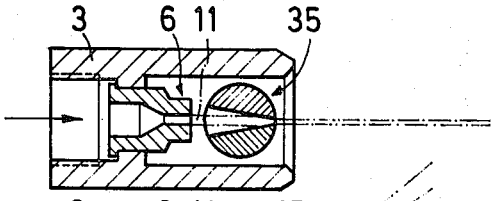
FIG. 7 is a view of the spray nozzle arrangement similar to FIG. 3 with a position of the deflector elements for producing a jet having a fan-shape of approximately 90°.
Figure 8:
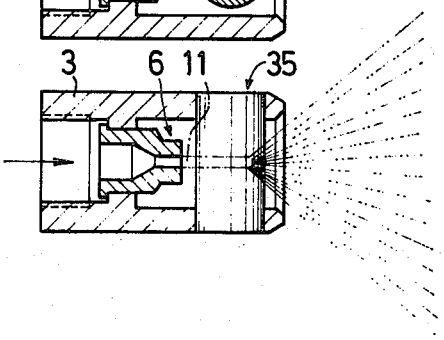
FIG. 8 is a view from above of the spray nozzle arrangement of FIG. 7.

By rotation of the actuator sleeve 23 and the guide sleeve 22 connected thereto, a rotary displacement of the shaft pieces 13 and 14 about the longitudinal axis of the bore is obtained. In this case the two shaft pieces 13 and 14 are rotated in opposition to one another through the same angle, so that their edges 33, 34 located opposite the outlet nozzle 6 enter symmetrically from the top and from the bottom into the jet 11 (FIG. 5). As illustrated in FIG. 6, the jet is spread-out fan-like thereby, namely with slight dipping of the edges 33 and 34, at a small angle (FIG. 6), with deeper dipping, at a greater angle (FIGS. 7 and 8). In between, all intermediate positions are adjustable in a stepless manner, i.e. the shaft pieces 13 and 14 with the faces 15 and 16 operate together as a deforming member 35 for the round jet 11, namely as a deforming member with two symmetrically disposed deflector elements.

Figure 9:
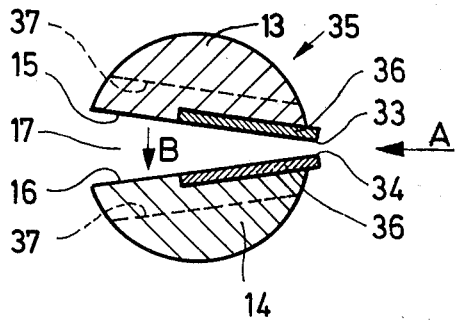
FIG. 9 is a sectional view of a further preferred constructional example of deflector elements.
Figure 10:
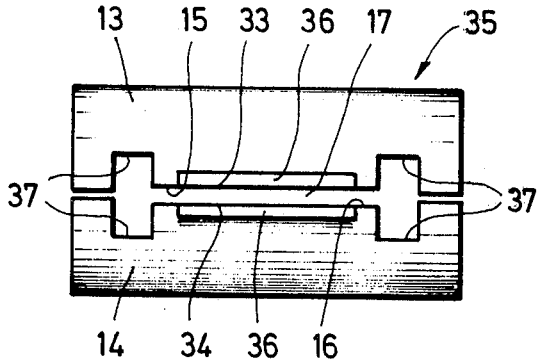
FIG. 10 is a frontal view of the deflector elements of FIG. 9 in the direction of arrow A in FIG. 9.
Figure 11:
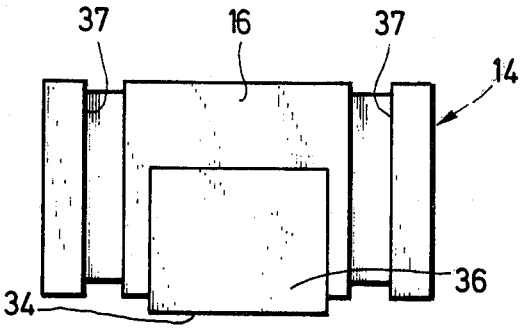
FIG. 11 is a view from above of the deflector elements of FIG. 9 in the direction of arrow B in FIG. 9.

Since the round jet impinges with great force on the faces 15 and 16 when these dip into the jet, it is advantageous to produce the swing elements (shaft pieces) of corrosion resistant and wear resistant material at least in the region of the faces 15 and 16, for example hardened high-grade steel, ceramic, or hard metal. As shown in FIGS. 9 to 11, it is preferable for the regions of the faces 15 and 16 which enter into the jet to be constructed from inserts of a corrosion resistant and wear resistant material. These inserts 36 may be in the form of plates which are inserted into appropriate recesses of the shaft pieces and under certain circumstances project forwardly in the direction of the jet beyond the periphery of the shaft pieces.

FIGS. 10 and 11 illustrate a further advantageous construction of the deflector elements (shaft pieces). The elements carry grooves 37 which extend in the flow direction and are arranged on the left-hand side and on the right-hand side of the gap 17, and which extend over the entire width of the shaft pieces. These longitudinal grooves form channels through which air can be sucked in, for example through the opening 31 and the slot 32 (FIG. 1). Thereby the properties of the jet may be improved in particular in the region of the border layer air-cleaning medium.

For interchanging the outlet nozzle 6, it is sufficient to unscrew the casing 3 with the guide sleeve 22 disposed thereon and the actuator sleeve 23, by rotation about the longitudinal axis and thus remove it from the spray pipe 1. In operation it is therefore simply possible to interchange the outlet nozzle 6.

The assembly of the whole nozzle arrangement is also extremely simple. First, when the casing 3 is not yet screwed upon the spray pipe 1, the shaft pieces 13 and 14 are pushed into the bore 12. Thereupon, the two guide half-shells 20 and 21 are placed over the casing 3 in such a manner that the extensions 19 of the shaft pieces 13 and 14 engage into the corresponding grooves or slots 27. Thereafter the actuator sleeve 23 is pushed from the back over the guide half-shells 20 and 21, the ledges 24 locating themselves thereby between the two guide half-shells 20 and 21. For the purpose of fixing the actuator sleeve 23 on the casing 3 and thus for fixing the whole arrangement, the pin 30 is finally inserted through the slot 29 into a corresponding opening in the casing and is secured there. The finished unit can then be screwed onto the spray pipe with the interposition of an outlet nozzle and is then ready for operation.

For a particularly favorable operation of the spray nozzle arrangement, the faces 15 and 16 may be finely ground or polished.

We claim:

1. A spray nozzle assembly adapted for connection with the supply conduit (1) of high pressure cleaning apparatus, comprising (a) an outlet nozzle (6) containing a longitudinal through bore of circular cross-section for producing a liquid jet (11);

(b) casing means for supporting said outlet nozzle in alignment opposite the supply conduit, said casing means including a generally tubular casing (3) adapted for connection at one end with the supply conduit, said casing containing intermediate its ends annular support means (4) for concentrically receiving said outlet nozzle;

(c) adjustable spray deforming means (35) mounted within said casing adjacent the other end thereof for converting the jet into a fan-shaped configuration, said deforming means including a pair of spaced shaft pieces (13, 14) having adjacent planar surfaces (15, 16), respectively, said shaft pieces being mounted transversely within said casing downstream of the outlet nozzle for rotation about a common axis normal to the casing axis between a first position in which said planar surfaces are opposite one another and parallel with the casing axis on opposite sides of the jet, and a second position in which said planar surfaces diverge in the direction of the outlet nozzle, portions of said planar surfaces remote from said outlet nozzle extending within the jet when said deforming means are in said second position, thereby to produce the desired fan-shaped spray configuration.

2. A spray nozzle assembly as defined in claim 1, and further comprising spacer elements arranged between said shaft piece planar surfaces.

3. A spray nozzle assembly as defined in claim 2, wherein said spacer elements comprise balls.

4. A spray nozzle assembly as defined in claim 1, wherein said casing includes a bore within which said shaft pieces are mounted, and further wherein each of said shaft pieces includes an extension, respectively, said extensions being arranged eccentrically with respect to said common axis and projecting laterally beyond said bore for rotating said shaft pieces.

5. A spray nozzle assembly as defined in claim 4, and further comprising a guide sleeve mounted on said casing for rotation about the casing axis, said guide sleeve containing a pair of symmetrically arranged obliquely extending grooves, each of said grooves being adapted to receive one of said extensions, respectively.

6. A spray nozzle assembly as defined in claim 5, wherein said guide sleeve comprises a pair of half-shell members, and further wherein an actuator member is non-rotatably connected with said pair of half-shell members.

7. A spray nozzle assembly as defined in claim 6, wherein said actuator member is formed from a poor heat-conductive material.

8. A spray nozzle assembly as defined in claim 1, wherein said shaft pieces are formed from a corrosion-resistant and wear-resistant material.

9. A spray nozzle assembly as defined in claim 8, wherein said material comprises one of hardened high-grade steel, ceramic, and hard metal.

10. A spray nozzle assembly as defined in claim 8, wherein the portions of said planar surfaces remote from said outlet nozzle comprise inserts of a corrosion-resistant and wear-resistant material.

11. A spray nozzle assembly as defined in claim 1, wherein said shaft piece planar surfaces contain a plurality of grooves extending parallel to the casing axis and across the entire width of said surfaces.

12. A spray nozzle assembly as defined in claim 11, wherein said outlet nozzle is interchangeable.

13. A spray nozzle assembly as defined in claim 12, wherein said casing is threadably connected with the supply conduit to force said outlet nozzle against an end face of the supply conduit.

14. A spray nozzle assembly as defined in claim 1, wherein said shaft pieces are mounted within said casing in a self-jamming fashion.

15. A spray nozzle assembly as defined in claim 1, wherein said planar surfaces are finely ground.

16. A spray nozzle assembly as defined in claim 1, wherein said planar surfaces are polished.

* * * * *